United States Patent [19]

Eimer et al.

[11] 4,406,031

[45] Sep. 27, 1983

[54] CLEANING MEMBER FOR CLEANING THE INTERIOR OF HEAT EXCHANGER TUBES

[75] Inventors: Klaus Eimer, Ratingen; Felix Kraker, Duisburg; Hans W. Schildmann, Heiligenhaus; Günther Schmitz, Moers; Hans Sonnenschein, Essen, all of Fed. Rep. of Germany

[73] Assignee: Taprogge Gesellschaft mbH, Düsseldorf, Fed. Rep. of Germany

[21] Appl. No.: 271,824

[22] Filed: Jun. 9, 1981

[30] Foreign Application Priority Data

Jun. 10, 1980 [DE] Fed. Rep. of Germany ..... 3021698

[51] Int. Cl.[3] ..... B08B 9/04

[52] U.S. Cl. ..... 15/104.06 R

[58] Field of Search ..... 15/104.06 R, 104.06 A, 15/3.5, 3.51

[56] References Cited

U.S. PATENT DOCUMENTS

| | | | |
|---|---|---|---|
| 3,651,530 | 3/1972 | Schultz | 15/104.06 R |
| 4,016,620 | 4/1977 | Powers | 15/104.06 R |
| 4,077,079 | 3/1978 | Knapp | 15/104.06 R |
| 4,242,771 | 1/1981 | Knapp | 15/104.06 R |

FOREIGN PATENT DOCUMENTS

| | | | |
|---|---|---|---|
| 1319094 | 5/1973 | United Kingdom | 15/104.06 R |
| 315896 | 12/1971 | U.S.S.R. | 15/104.06 R |

*Primary Examiner*—Edward L. Roberts

*Attorney, Agent, or Firm*—Herbert L. Lerner; Laurence A. Greenberg

[57] ABSTRACT

Cleaning member for cleaning the interior of heat exchanger tubes by rotating, including a sponge rubber element being adapted to suit the diameter of the heat exchanger tube, and abrasive elements connected to the sponge rubber body, the abrasive elements being in the form of bristles each having a bristle shaft, and a bristle base molded into the sponge rubber ball anchoring the bristles.

4 Claims, 4 Drawing Figures

CLEANING MEMBER FOR CLEANING THE INTERIOR OF HEAT EXCHANGER TUBES

The invention relates to cleaning members for cleaning the interior of heat exchanger tubes by circulatory or rotating action, especially tubes of condensers in steam power plants. The cleaning members include a sponge-rubber element which is adapted to suit the tube diameter, and abrasive elements connected therewith. For example, the tube diameter may lie in the range of 10 to 50 mm. The sponge-rubber elements in general are of the type having open pores. The term sponge-rubber is to be understood to include natural rubber as well as synthetic rubber. The cleaning method in which the above-mentioned cleaning members are used is generally known in the field as the Taprogge-method.

In the known measures used in practice, the abrasive elements are grains made of a suitable material, such as corundum. A disadvantage of this proven method is that the abrasive effect is too great, due to the high hardess of the corundum. A further disadvantage is that these cleaning members are not suited for tubes having a profile which deviates from a circular form.

Furthermore, in practice, not only are sponge-rubber elements with abrasive elements disposed thereon, known as cleaning members for cleaning the interior of heat exchanger tubes, but also so-called cleaning-brushes are known. The latter include a brush-core with bristles, are basically of cylindrical shape, and are provided at their ends with plate-shaped elements. Cleaning members of this type are not suited for cleaning the tubes by rotary action. They are stationary within the tubes, and are moved back and forth by reversing the flow direction of the heat exchange medium. This process is very complicated.

It is accordingly an object of the invention to provide a cleaning member for cleaning the interior of heat exchanger tubes, which overcomes the hereinaforementioned disadvantages of the heretofore-known devices of this general type, and to do so in such a way that they are less abrasive than those coated with corundum, and are also well suited for the cleaning of profiled or irregularly shaped tubes.

With the foregoing and other objects in view there is provided, in accordance with the invention, a cleaning member for cleaning the interior of heat exchanger tubes, especially tubes of condensers in steam power plants, by rotating or circulating, comprising a sponge rubber element being adapted to suit the diameter of the heat exchanger tube, and abrasive elements connected to the sponge rubber body, the abrasive elements being in the form of bristles each having a bristle shaft, and a bristle base molded into the sponge rubber ball anchoring the bristles. This can be accomplished in various ways.

In accordance with another feature of the invention, the bristles are in the form of U-shaped mono-filament sections each having U-legs and a U-crosspiece, the anchoring bristle base being formed by the U-crosspiece and two of the bristle shafts being formed by the U-legs.

In accordance with a further feature of the invention, the bristles are nail shaped and each have a nail head forming the anchoring bristle. The bristles may be formed for example, of synthetic-glass fibers or wire. However, they could also be natural bristles.

In the cleaning members according to the invention, the abrasive elements are embedded with their bases in the sponge rubber element, i.e. they are molded into or foamed-into the latter. This implies that the bristles are inserted into the molds in which the sponge-rubber elements are produced, either by an injection and/or expansion process. The mold for producing the sponge-rubber elements is constructed so as to correspond to the shape of the elements. The manufacture of the cleaning members is especially simple if, in accordance with an added feature of the invention, the bristle anchoring base is in the form of a bristle carrier which may be injection molded, a multiplicity of the bristle shafts being connected on the outside of the bristle carrier. The bristle carrier may be an injection molded ring or bar, which forms the anchoring base. Such rings or bars can be inserted in a conventional mold for producing sponge rubber elements.

In accordance with a concomitant feature of the invention, the sponge rubber element is spherical or cylindrical.

Depending on the length thereof, the bristle shaft protrudes from the sponge-rubber element by a given distance, and the cleaning elements are not only suited for tubes which have a circular inside diameter, but also for tubes which are oval or whose wall is profiled for example.

Other features which are considered as characteristic for the invention are set forth in the appended claims.

Although the invention is illustrated and described herein as embodied in a cleaning member for cleaning the interior of heat exchanger tubes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
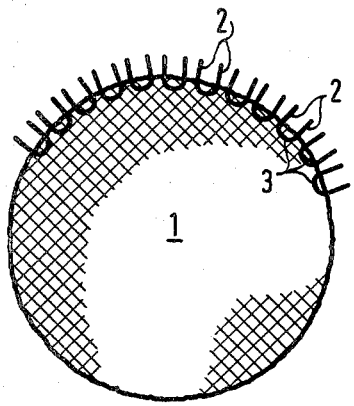
FIG. 1 is an enlarged diagrammatic radial-sectional view of a cleaning member according to the invention.

Referring now to the figures of the drawing and first particularly to FIG. 1 thereof it is seen that the cleaning member shown in the figures is intended for cleaning the interior of heat exchanger tubes, especially tubes of condensers of steam power plants, and is applicable for use in a cleaning method wherein the cleaning member rotates. In its basic construction, the cleaning member includes a sponge-rubber element 1 which is adapted to suit the tube diameter, and the abrasive elements 2, 3 connected to the sponge rubber element. The abrasive elements 2, 3 are shown in exaggerated heavy lines in the figures for reasons of clarity.

In the illustrated embodiments the abrasive elements can be made as, but are not limited to, bristles of a synthetic material, including a bristle shaft 2 and a bristle base 3, and can be anchored by the bristle base by molding it into the sponge rubber element 1.

Figure 3:
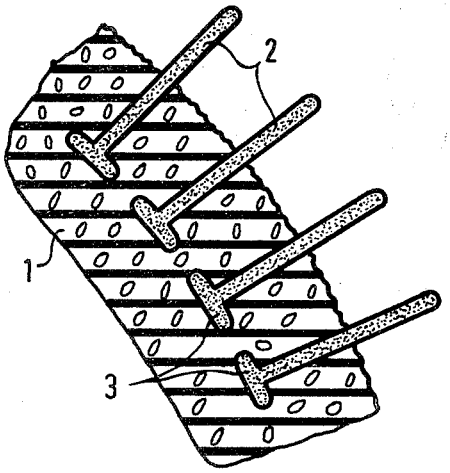
FIG. 3 is a fragmentary diagrammatic view of another embodiment of the subject matter of FIG. 1, in further enlarged scale as compared to FIG. 1.

In the embodiment form according to FIG. 1, the plastic bristles are made in the form of U-shaped, plastic mono-filament sections. The crosspiece of the U-shape forms the anchoring base 3. The legs of the U-shape of each of these abrasive elements form the two bristle shafts 2. In the embodiment according to FIG. 3, the plastic bristles are constructed so as to be nail-shaped, wherein the nail-head forms the anchoring base 3.

Figure 2:
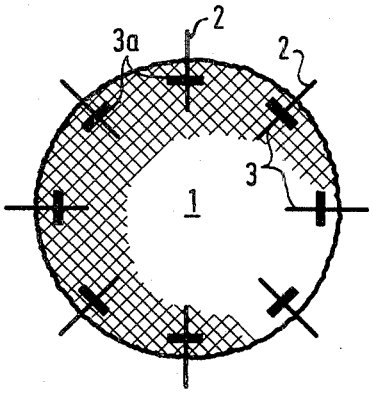
FIG. 2 is a view similar to FIG. 1 of another embodiment of a cleaning member according to the invention.
Figure 4:
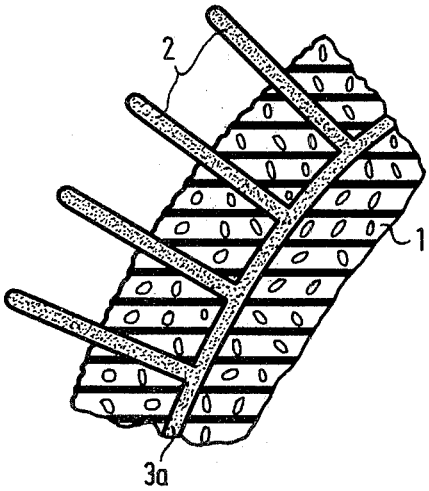
FIG. 4 is a view similar to FIG. 3 of another embodiment of the invention.

Another advantageous embodiment is shown in FIGS. 2 and 4. It is seen in these figures that the plastic bristles are connected with a bristle carrier 3*a*. The bristle carrier 3*a* carries the bristle shafts 2 at the outside thereof, either in one row or in several rows. The illustrated cleaning members can first as well be spherical bodies or cylindrical elements.

There is claimed:

1. Cleaning member for cleaning the interior of heat exchanger tubes by circulating through the tubes under pressure of liquid in the tubes, comprising a spherical homogeneous element formed of uncoated sponge rubber being directly exposed to the liquid in the tubes for absorbing the liquid and having a cross section adapted to suit the diameter of the heat exchanger tube, and abrasive elements connected to said sponge rubber element, said abrasive elements being in the form of non-metallic bristles each having a bristle shaft freely extending beyond the surface of the sponge rubber element, and a bristle base directly molded into the sponge rubber of said sponge rubber element anchoring said bristles.

2. Cleaning member according to claim 1, wherein said bristles are in the form of U-shaped mono-filament sections each having spaced-apart rectilinear legs and a U-crosspiece, said anchoring bristle bases being formed by said U-crosspieces.

3. Cleaning member according to claim 1, wherein said bristles are nail shaped and each have a nail head forming said anchoring bristle base.

4. Cleaning member according to claim 1, wherein said bristle anchoring base is in the form of a bristle carrier, a multiplicity of said bristle shafts being connected on the outside of said bristle carrier, said bristle carrier being directly molded into said sponge rubber element.

* * * * *